US006385922B1

(12) United States Patent
Mors

(10) Patent No.: US 6,385,922 B1
(45) Date of Patent: May 14, 2002

(54) SOLAR LIGHT RECEIVING AND SIDE EMITTING SYSTEM

(76) Inventor: John A. Mors, 1560 Eastman Ave., Ventura, CA (US) 93003

( * ) Notice: Subject to any disclaimer, the term of this patent is extended or adjusted under 35 U.S.C. 154(b) by 0 days.

(21) Appl. No.: 09/585,303

(22) Filed: Jun. 1, 2000

Related U.S. Application Data

(60) Provisional application No. 60/137,192, filed on Jun. 2, 1999.

(51) Int. Cl.[7] ..... E04B 1/76

(52) U.S. Cl. ..... 52/173.3; 52/200; 52/28; 52/DIG. 17

(58) Field of Search ..... 52/173.3, 200, 52/473, DIG. 17, DIG. 8, 28; 47/17

(56) References Cited

U.S. PATENT DOCUMENTS

| | | | | | |
|---|---|---|---|---|---|
| 1,652,347 | A | * | 12/1927 | Champeau | 52/200 |
| 2,858,734 | A | | 11/1958 | Boyd | 88/59 |
| 3,350,819 | A | * | 11/1967 | Polidoro et al. | 52/200 |
| 3,562,972 | A | * | 2/1971 | D'Amato | 47/17 |
| 4,003,365 | A | * | 1/1977 | Wiegand et al. | 126/271 |
| 4,171,600 | A | * | 10/1979 | Whitney, Jr. | 52/745 |
| 4,280,480 | A | | 7/1981 | Raposo | 126/429 |
| 4,339,900 | A | | 7/1982 | Freeman | 52/200 |
| 4,409,767 | A | | 10/1983 | Jentoft et al. | 52/200 |
| 4,428,358 | A | * | 1/1984 | Adamson | 126/417 |
| 4,559,925 | A | * | 12/1985 | Snow | 126/430 |
| 4,576,440 | A | | 3/1986 | Worthington | 350/258 |
| 4,601,139 | A | * | 7/1986 | Esposito | 52/90 |
| 4,602,613 | A | * | 7/1986 | Barr | 126/424 |
| 4,733,505 | A | | 3/1988 | Van Dame | 52/22 |
| 4,733,506 | A | * | 3/1988 | Gunnarshaug | 52/22 |
| 4,809,468 | A | | 3/1989 | Bareiss | 52/22 |
| 4,833,838 | A | | 5/1989 | Van Dame | 52/22 |
| 5,027,566 | A | * | 7/1991 | Giloswski | 52/18 |
| 5,099,622 | A | | 3/1992 | Sutton | 52/200 |
| 5,175,967 | A | | 1/1993 | Greenwood | 52/100 |
| 5,408,795 | A | | 4/1995 | Eljadi et al. | 52/173.3 |
| D390,976 | S | * | 2/1998 | Weston | D25/199 |
| 6,178,707 | B1 | * | 1/2001 | Bengston | 52/200 |

* cited by examiner

*Primary Examiner*—Carl D. Friedman
*Assistant Examiner*—Phi Dieu Tran A
(74) *Attorney, Agent, or Firm*—Kenneth J. Hovet

(57) ABSTRACT

A solar light enclosure is provided with a light receiving top opening and a light emitting bottom opening. The enclosure also includes lateral light extraction panels for emitting light from the sides of the enclosure. The panels may incorporate lens structures, prisms, baffles and reflector elements to transmit light in selected lateral directions. The panels may be attached to the enclosure by hinges and be tiltable away from the enclosure to further enhance illumination toward selected side areas. The enclosure interior may include light control partitions to direct portions of light toward the light extraction panels while simultaneously transmitting other portions of light downwardly and out the enclosure bottom opening. The partitions may be sized, shaped and adjusted angularly to create patterns of light for illuminating specified work areas, hallways and architectural structures.

25 Claims, 6 Drawing Sheets

SOLAR LIGHT RECEIVING AND SIDE EMITTING SYSTEM

This application claims priority from provisional application No. 60/137,192 filed Jun. 2, 1999.

BACKGROUND OF THE INVENTION

1. Field of the Invention

The present invention relates to interior lighting utilizing natural lighting fixtures. In particular, the invention concerns a skylight enclosure adapted to receive solar light and distribute the received light to selected areas of a building interior.

2. Description of Related Art

The idea of converting a skylight dome in one's roof to a more useful item that will effectively distribute light and illuminate desired areas of an interior, has resulted in the creation of a wide variety of elaborate and complicated solar lighting systems. For example, U.S. Pat. No. 5,099,622 discloses a roof mounted skylight from which extends a tubular structure that terminates about flush with the ceiling of a room. The domed portion of the skylight extending above the roof is transparent and includes a reflector. The reflector captures a portion of sunlight that would otherwise pass through the dome and directs it into the underlying tubular structure. The reflected light exits the structure through a concave diffuser which scatters the captured light throughout a room.

The above system is inefficient because all light entering the tubular structure can only exit through the downward facing diffuser. Therefore, no matter how concave the diffuser is, there will still be dark areas around the room. Additionally, the reflector will also shield some of the sunlight during certain times of every day. As a result, less sunlight will enter the structure causing diminished illumination.

U.S. Pat. No. 5,175,967 seeks to overcome the above deficiency by placing a reflective surface at an inner lower terminal end of the tubular housing. The mirror is positioned at a 45° angle to direct light through a window placed in the side of the housing. An objection to this arrangement is that the mirror itself blocks out a substantial portion of light that could otherwise be directed out of the bottom of the structure. Thus, while light is directed out one portion of the housing, the area directly beneath the structure is severely deficient in illumination. Further, the side window through which reflected light exits, has no means for adjustment or for inhibiting sunlight glare.

A more sophisticated passive lighting system using a glass dormer structure for a roof is shown in U.S. Pat. No. 5,408,795. This elaborate system allows light to pass through openings in the glass dormer and become softened and diverted by passing through layers of diffusers, mirrors and fresnel lens panels. A primary function of the system is to enable an inside person to view outdoor images, while also dispersing ambient daylight. This, of course, results in lower amounts of overall illumination and defeats the purpose of most skylight assemblies.

SUMMARY OF THE INVENTION

A significant attribute of the present invention is the ability to enhance light captured in a solar lighting enclosure and transmit the light out the sides of the enclosure in a controlled manner without glare and with minimal loss to the light intensity. The system provides a housing having light reflecting interior surfaces between a light admitting top opening and a light emitting bottom opening. The enclosure includes a lower wall portion within which is incorporated light directing means comprising side extraction panels through which light, collected from within the enclosure, passes outwardly in predetermined directions.

One or more side extraction panels may be used depending on the location of the interior building areas to be illuminated. When the system is used to illuminate hallways or aisles, the side extraction panels can be positioned on sides of the enclosure that face the above areas.

If even more light is desired for specific work areas or selected decorative areas of a room, the side extraction panels may be provided with light guide means incorporated into the panels to direct light specifically to those areas. Conversely, if more indirect lighting is desired, the guide means can transmit light toward a reflective ceiling. The panels may also be equipped with tilt adjustment mechanisms for rotating the panels away from the enclosure lower wall portion. This permits light to be directed at a more downwardly inclined angle than is possible with internal guide means.

In cases where it is more important to direct most of the light outwardly through the side extraction panels, the interior of the enclosure may be provided with light control means. The light control means transmits a portion of the enclosure light to an underlying diffuser while simultaneously reflecting other portions of the light toward the side extraction panels. The light control means may comprise flat, curved or fluted light control partitions that are sized to be equal to, or less than, the entire area of the enclosure light emitting bottom opening. More than one partition may be used and each partition may be fixed in place or be rotatable.

The light control partitions may also have varying shapes such as triangular, polygonal, round, oval and trapezoidal. Still further, as with the side extraction panels, the light control partitions may be equipped with angular adjustment means such as slotted brackets, pawl and rachet assemblies, piston/shaft air or hydraulic devices, jack screw and related apparatus known in the art. When the size and shape of the light control partitions are coordinated, they may operate together to create variable sized open areas to allow light to pass unobstructed out the enclosure bottom light emitting opening. This feature may be used to delineate emitted light patterns for special illumination needs.

The efficiency of the overall system is improved by utilizing a light collimator over the enclosure light admitting top opening. This will allow better alignment and reflection of the light rays within the enclosure and will diminish the effects of sun glare. It is also advantageous to provide a light diffuser sheet over the light emitting bottom opening to further reduce glare and to enhance the distribution of light in a downward direction.

DESCRIPTION OF THE PREFERRED EMBODIMENTS

Figure 1:
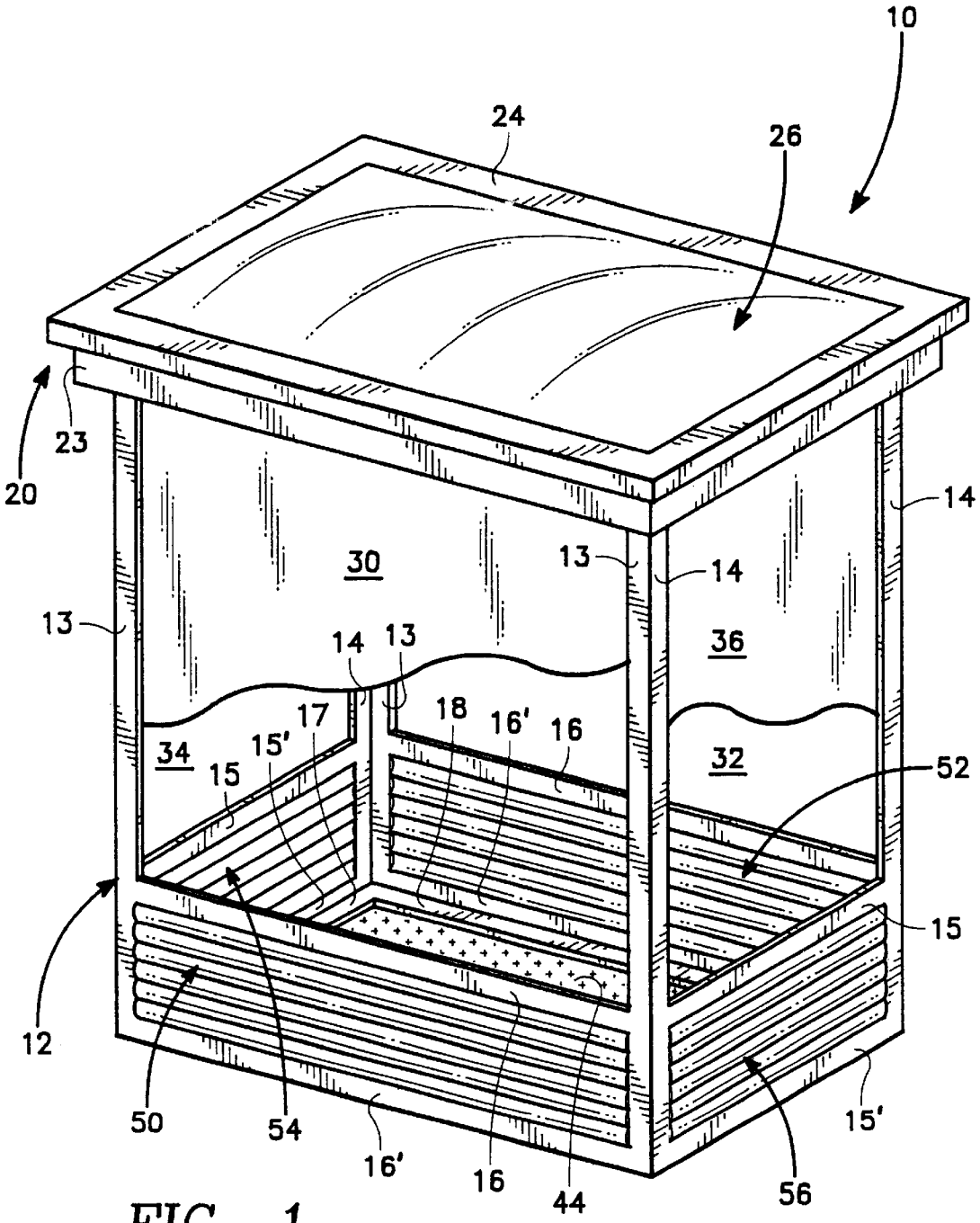
FIG. 1 is an isometric front view of the overall light enclosure of the present invention with portions of the front and right sidewalls broken-away to show side extraction panels about the lower portion of all sidewalls.

With reference now to the drawings, the overall solar light enclosure system is shown generally by reference 10. The system is depicted as having a polygonal cross-section circumscribed by a rigid framework 12. Depending on the specific application, the enclosure could have a triangular or round cross-section The height of the structure will be dictated by the building roof height and how close one wishes to position the solar light emissions to specified areas. Also, the total cross-sectional area of the enclosure will be a matter of choice in relation to the total amount of light one wishes to distribute.

The basic framework 12 consists of four upstanding angle members comprising face member 13 and side member 14. The members are located at each corner of the enclosure and connect at their uppermost points with a mounting structure 20. At their lowermost points they connect with respective bottom side plates 17 and bottom face plates 18. The bottom plates extend inwardly to inner plate edges that define light emitting bottom opening 42.

In the lower half portion of framework 12 are cross-pieces that interconnect the upstanding members. As shown in FIG. 1, mid-side pieces 15,15 extend between corresponding face members 13,13. Similarly, lower side pieces 15',15' extend across the framework bottom and interconnect opposing side members 14,14. Lower face pieces 16',16' interconnect opposing face members 13,13.

Figure 2:
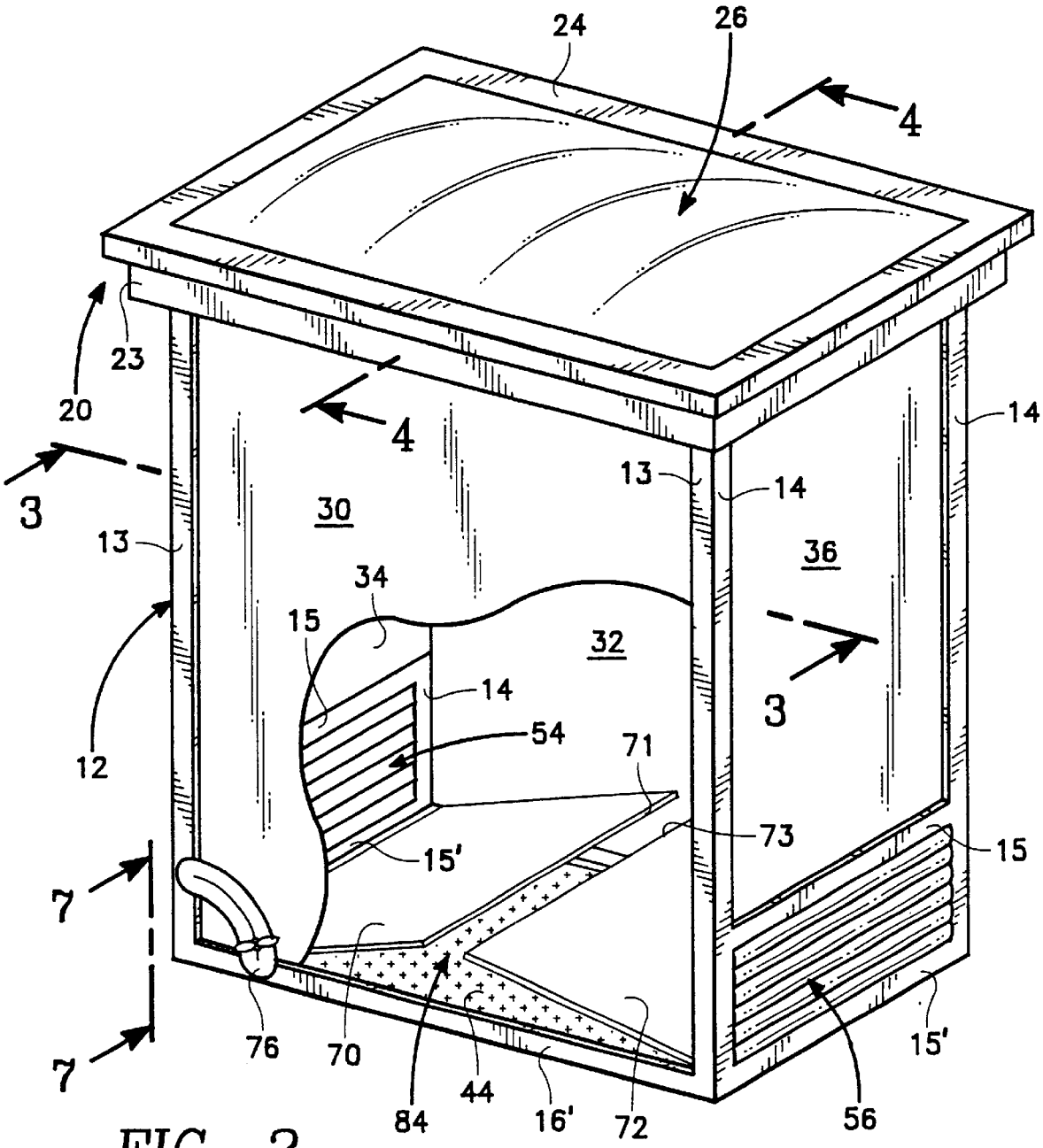
FIG. 2 is an isometric view of the enclosure shown in FIG. 1 with a portion of the front wall broken-away to reveal a side extraction panel on a left side wall of the enclosure and with light control partitions added to the enclosure interior.

The areas below mid-side pieces 15,15 and mid-face pieces 16,16 and above lower pieces 15',15' and 16',16' between respective portions of the upstanding members 13,14, comprise panel openings for placement of light directing means shown as side extraction panels. The panels are referenced as front panel 50, back panel 52, left panel 54 and right panel 56. In FIG. 2, it will be noted that the cross pieces 15,16 have been omitted whereby only left and right side extraction panels 54,56 are shown.

The upper ends of the upstanding frame members 13,14 are interconnected by the aforementioned mounting structure 20. The mounting structure also provides a means to disperse any accumulated condensation and vent air as needed during daily and seasonal heat and cooling cycles. Additionally, it connects protective dome 26 and collimator 28 to the framework 12.

The mounting structure comprises a gutter plate 21 that projects outwardly from the top end of each upstanding frame member 13,14. It extends around the entire periphery of the enclosure. Extending upwardly from the gutter plate outward from the upstanding frame members, is a spacer part 22. The spacer part includes a flattened free end portion for engaging the underside of overlaped peripheral margins of dome 26 and collimator 28. At the outermost end of the gutter plate is a skirt 23 that flares downwardly a distance sufficient to provide a peripheral weather shield for the overall mounting assembly.

Overlapping a portion of the skirt and the dome and collimator margins, is L-shaped bracket 24. The bracket includes gasket and/or sealant materials to help insure a strong weatherproof connection.

It will be noted that the foregoing description of the mounting structure and its connection to the enclosure has been simplified for ease of understanding of the overall system. It does not form a part of the present invention. It will also be appreciated that additional means will be required to sealingly engage the enclosure or mounting structure to the roof of a building.

To complete the enclosure, the framework open areas above the extraction panel openings are covered with wall structures shown as frontwall 30, backwall 32, left sidewall 34 and right sidewall 36. Preferably, the wall structures comprise a rigid flat insulative material 38, such as foamed resin or plastic. They include an inner layer 39 of reflective metalized film or a polished sheet of metal. The wall structures are sealingly fixed, by mechanical fasteners and/or adhesives, to the inner surfaces of the upstanding frame members and cross pieces. Their top ends will preferably be straight and about coextensive with gutter plate 21 to define enclosure light admitting top opening 40.

As shown in FIG. 1, there are four light extraction panels located above the light emitting bottom opening 42. They may be fixed in place and emit light from all four sides of the enclosure. This version is suitable for positioning in the center of a room to provide ambient 360° light. The FIG. 2 embodiment, with left and right side extraction panels 54, 56, is best suited for positioning above narrow halls or aisles.

In both embodiments, the guide means for the side extraction panels is shown as comprising multiple horizontally aligned lectilinear lens structures. Depending on the type of lens material and it's configuration, the light transmitted will be distributed outwardly at a wide angle less than 180°. If it is desired to direct the light in a predetermined direction, the panels may comprise a variety of other guide means such as internal light deflecting baffles, pre-aligned prisms, polarized or holographic light film, interior reflectors, shutters and other types of lens designs.

The guide means includes another alternative for directing light. This involves mounting the panels so that they can tilt outwardly from the enclosure walls. To accomplish the above, selected panels may be attached to corresponding upper or lower cross pieces with hinges. With each extraction panel having a top edge 60 and bottom edge 61, the hinge can be attached preferably to either edge and rotate upwardly to direct light toward a ceiling or downwardly to illuminate specified lower areas. As best shown in FIGS. 3 and 7–9, hinge 58 is attached to lower side and face pieces 15',16' and to edge 61 of left and right side extraction panels 54,56 by fastening means such as pins, bolts, screws, rivets and adhesives.

Figure 9:
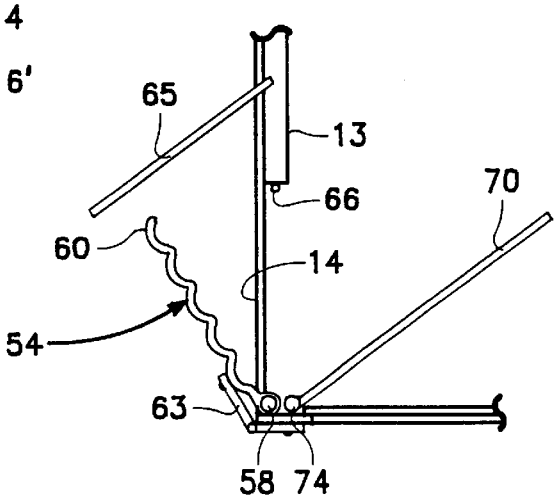
FIG. 9 is a fragmentary view similar to FIG. 7 showing outward tilting of a side extraction panel and including a reflector shield extending angularly above the tilted side extraction panel.

The hinged panels may include a tilt adjustment mechanism for releasably securing the panels in a selected angular position. As shown in FIG. 9, an adjustable bracket 63 is illustrated which is externally mounted beneath hinge 58. In ways known in the art, the bracket will be hinged and include notched guideways, rachet mechanisms or simple hinge shaft tightening means known in the art for fictionally inhibiting rotation of the bracket (and panel). Other tilt adjustment mechanisms could also be used in place of the bracket. Examples are rotatable screw jacks, pneumatic/hydraulic piston assemblies and electro/mechanical solenoid systems.

To ensure that a maximum amount of light will be directed downwardly when the panel is tilted outwardly, an optional reflective shield 65 may be used as shown in FIG. 9. The shield may be flat or curved and may be angularly adjustable. It extends outwardly from the housing framework to overlie that portion of the space between panel top edge 60 and the enclosure wall. In this way, any light that might escape out of the aforementioned space will be reflected downwardly in the desired direction.

Figure 8:
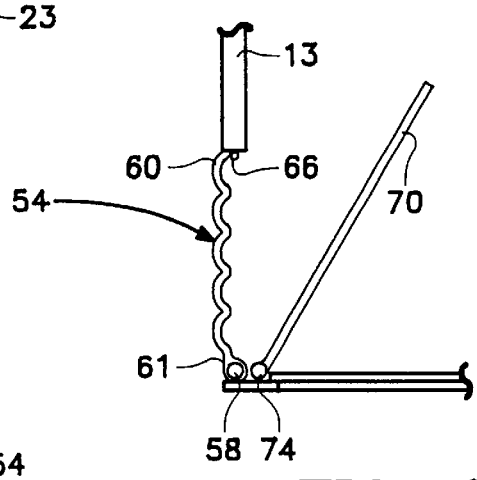
FIG. 8 is a corner fragmentary view similar to FIG. 7 showing a different angular position of the light control partition.

When the panels are provided with a tilt adjustment mechanism, it is preferable to provide an enclosure abutment seal for at least the panel top edge 60. Thus, when the panel is in a closed position coextensive with a corresponding side wall, as depicted in FIG. 8, a gasket seal 66 is positioned along a portion of mid-side cross piece 15.

To further enhance the performance and effectiveness of the light extraction panels, light control means may be incorporated into the enclosure interior. The light control means preferably comprises one or more light control partitions located to extend at an angle starting from below the extraction panels and extending inwardly into the enclosure interior. The partitions are preferably flat rigid structures having variable light transmitting and reflecting characteristics. They may comprise composites of glass, plastic and metal. Clear plastics such as acyclics and polycarbonates, along with pre-formed metal sheets, all may be used alone or in combination. A particularly suitable material useful with the invention for both transmitting and reflecting light, is LEXALITE by Lexalite International Corp. This material comprises a laminate of clear acrylic with a perforated polished aluminum film.

The light control partitions are preferably angularly adjustable. For this purpose the lower end of each partition is provided with a hinge 74 which interconnects the partition with corresponding bottom side and face plates 17, 18.

Figure 7:
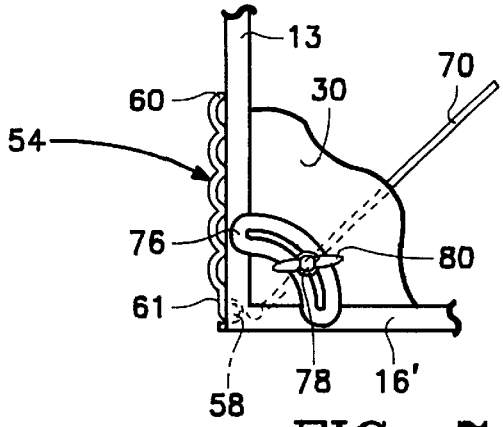
FIG. 7 is a fragmentary side elevational view taken along lines 7—7 of FIG. 2 illustrating a tilting mechanism for rotating a light control partition.

To secure each partition at a selected angular position, releasable adjustment means known in the art may be used. For illustrative purposes only, FIGS. 2 and 7 show a slotted bracket 76 that is mounted to framework lower face piece 16' and upstanding face member 13. Housing front wall 30 is provided with a corresponding slot and a side edge of partition 70 includes a guide pin 78 that extends laterally through the wall slot and bracket. The end of the guide pin is threaded to accommodate a lock washer (not shown) and wingnut 80 for loosening and tightening the guide pin to the bracket. Tightening the wing nut will fix the partition at a selected position by frictional compression engagement.

Figure 3:
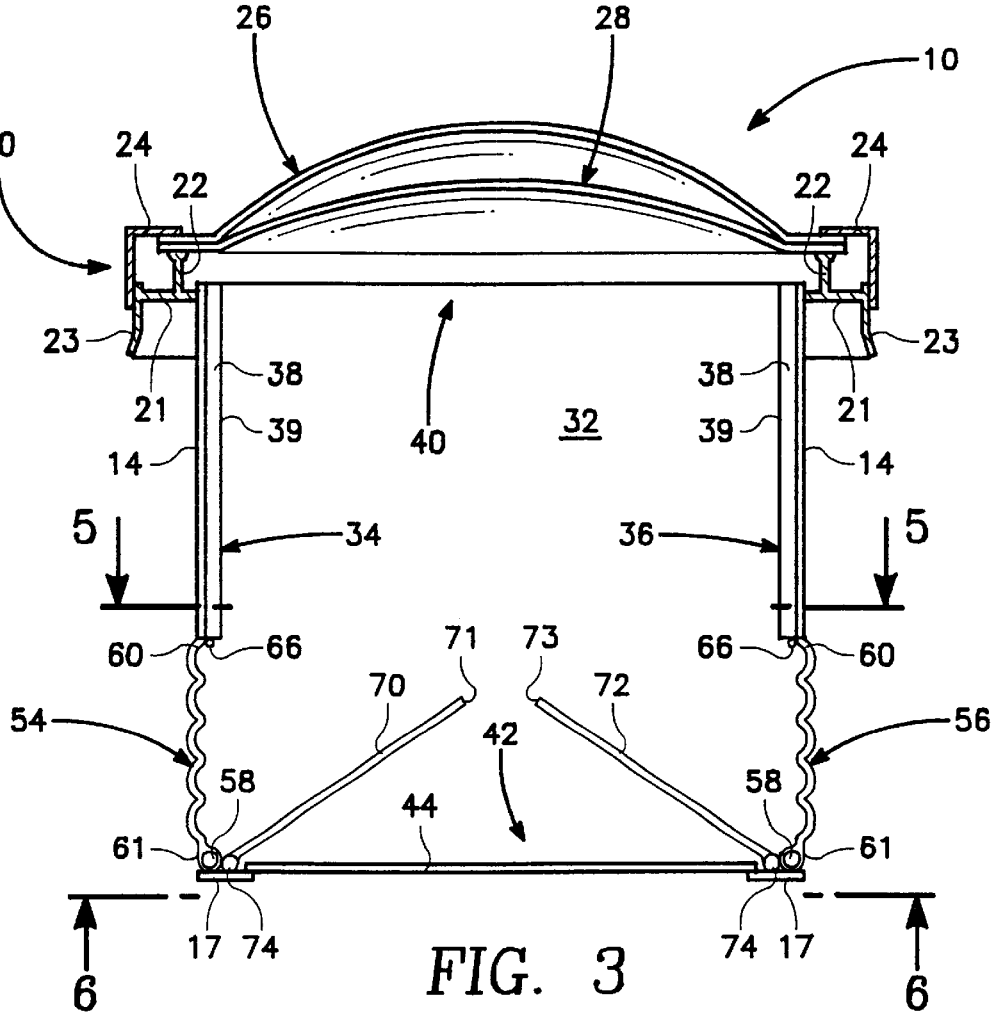
FIG. 3 is an elevational cross-section view taken along lines 3—3 of FIG. 2.
Figure 6:
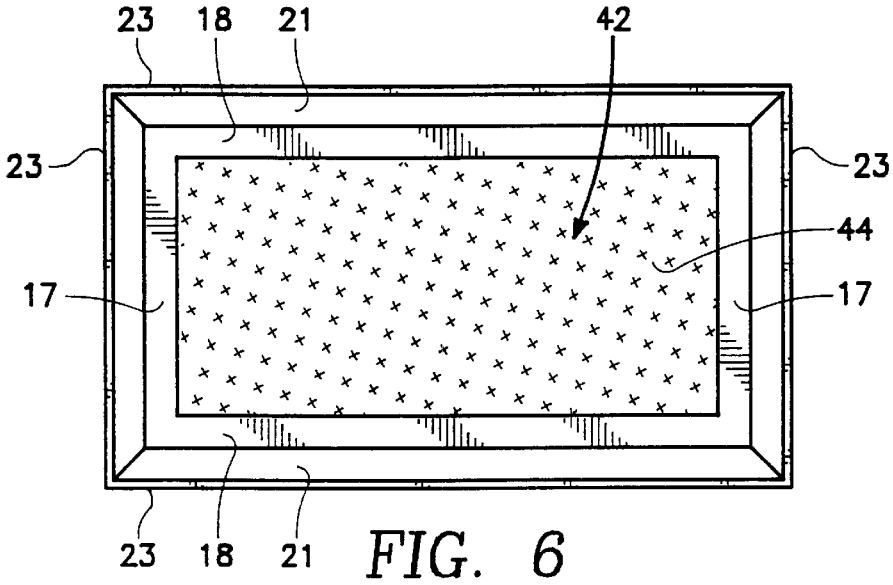
FIG. 6 is a bottom plan view taken along lines 6—6 of FIG. 3.
Figure 4:
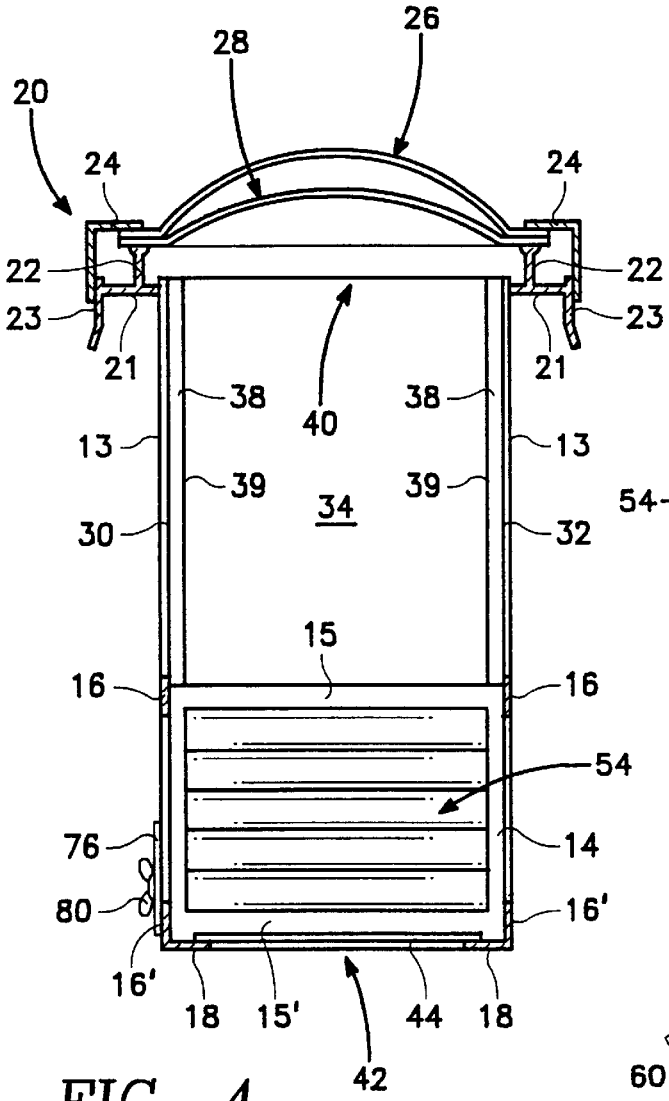
FIG. 4 is a cross-sectional plan view taken along lines 4—4 of FIG. 2.
Figure 5:
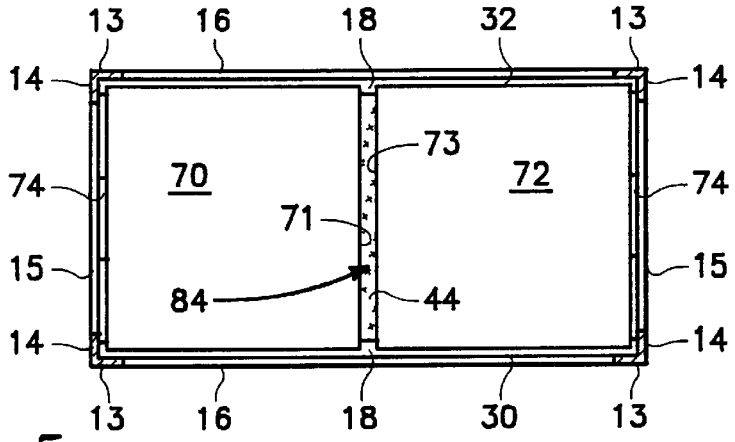
FIG. 5 is a cross-sectional view taken along lines 5—5 of FIG. 3.

It can be seen that the partitions, in combination, can create a variety of emitted light patterns by changing their size, shape and relative positions. With particular reference to FIGS. 2, 3 and 5, leading edges 71, 73 of respective partitions 70, 72 are shown spaced-apart a short distance. The space between the edges creates a slot opening 84 for allowing light to pass directly to diffuser sheet 44 and then downwardly to a selected area. The farther apart the partition leading edges are, the more direct light will be available for downward illumination.

In general, the light opening may be varied by the angle of each partition with respect to the other and by the length of each partition. Additionally, the partitions themselves may be narrower than the width of the enclosure interior. This construction creates openings about the side edges of the partitions and results in more downwardly directed light and less light directed toward the side extraction panels.

Figure 5A:
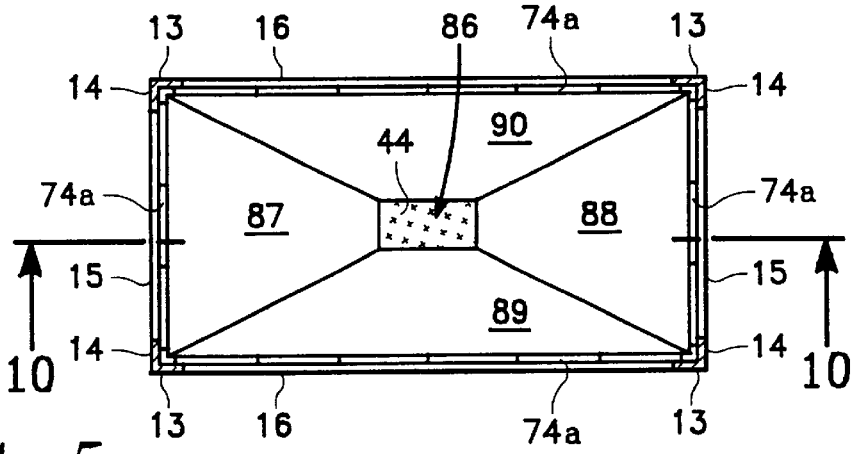
FIG. 5*a* is a first variation of the light control partitions shown in FIG. 5.
Figure 10:
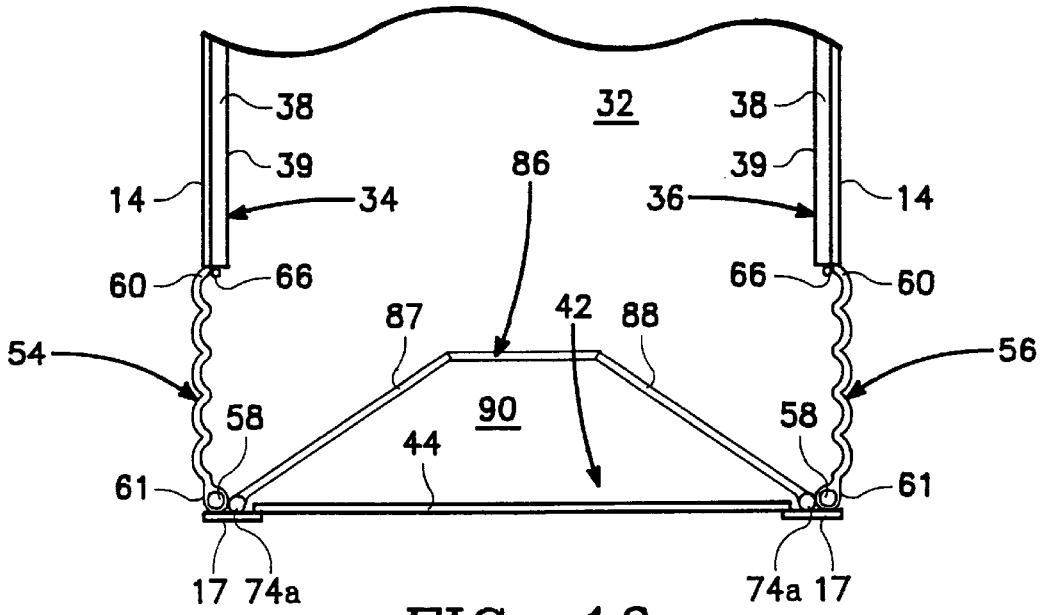
FIG. 10 is a cross-sectional view taken along lines 10,10 of FIG. 5*a*.

The partitions may also have varying geometrical shapes which can be used to create a selected downwardly directed light pattern. For example, FIGS. 5*a* and 10 illustrate four corresponding trapezoidal shaped partitions shown by references 87–90. The partitions are connected to respective portions of the bottom plates 17, 18 with hinges 74*a*. When the partitions are brought together, their leading edges create a polygonal shaped light opening 86.

Figure 5B:
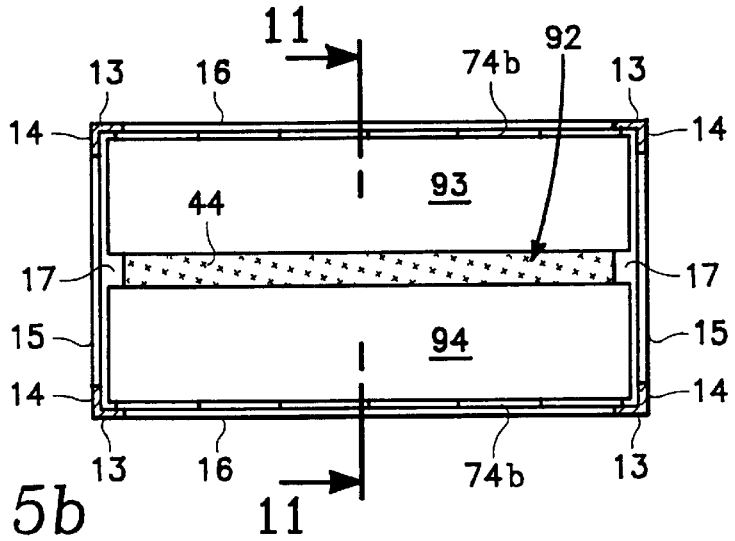
FIG. 5*b* is second variation of the light control partitions shown in FIG. 5.
Figure 11:
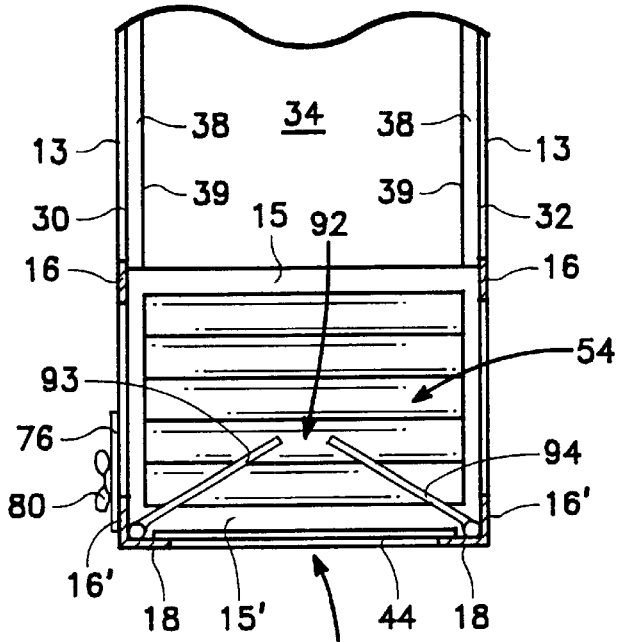
FIG. 11 is a cross-sectional view taken along lines 11,11 of FIG. 5*b*.

FIGS. 5*b* and 11 show that if it is desired to create an elongated direct light pattern, rectangular front and back partitions 93, 94 may be secured to respective bottom face plates 18, 18 by hinges 74*b*. The partitions extend lengthwise along the entire length of the enclosure. Depending on the width and angular position of the partitions, a longitudinal light opening 92 will be created. When light from within the enclosure passes directly through the opening 92 and diffuser sheet 44, a bright elongated narrow light pattern will be emitted downwardly. It is expected that each of the FIGS. 5*a* and 5*b* embodiments will include releasable securement means, such as the bracket assembly 76 shown in FIG. 7, or equivalent means known in the art.

In consideration of all the above enumerated variations, it can be seen that the enclosure of the invention is adaptable for a wide variety of applications and has sufficient versatility to be a replacement for, or at least a strong environmentally desirable supplement to, electrical light fixtures during daylight hours. Therefore, while the above descriptions set forth illustrative embodiments in detail, it will be apparent that still further variations and modifications may be made without departing from the spirit and scope of the invention. As such, the invention is intended to encompass all of such variations that come within the purview of the appended claims and should not be limited by the aforementioned illustrative embodiments.

I claim:

1. A solar light receiving and distribution apparatus comprising:

a housing defined by enclosure walls having light reflecting interior surfaces between a light receiving end and a light distributing end;

each of said enclosure walls having a lower wall portion proximate said light distributing end; and, a light extracting panel positioned in at least one of said lower wall portions, said panel having guide means for directing light in predetermined directions outwardly from the side of said housing.

2. The apparatus of claim 1 wherein said guide means is a member selected from the group consisting of light deflecting baffles, prisms, polarized light film, holographic light film, light reflectors, shutters, lens structures and tilt adjustment mechanisms for rotating said extraction panel away from said lower wall portion.

3. The apparatus of claim 2 wherein the interior of said housing proximate said lower wall portion includes a light control means for directing predetermined amounts of light toward said light extraction panel.

4. The apparatus of claim 3 wherein said light control means comprises one or more light control partitions connected to said housing.

5. The apparatus of claim 4 wherein at least one of said light control partitions transmits light toward said light distributing end and reflects light toward said light extraction panel.

6. The apparatus of claim 4 wherein said light distributing end has a defined outlet area and said light control partition is hingably attached to said housing and overlies an area less than said defined outlet area.

7. The apparatus of claim 6 wherein two or more light control partitions are adjustably movable toward and away from each other.

8. The apparatus of claim 7 wherein said defined outlet area has peripheral margins and said light control partitions have a predetermined shape defined by an inner edge, side edges and an outer edge, said outer edge being hingably attached proximate to corresponding portions of said peripheral margins, said inner edge and side edges defining the boundaries of a light opening created by the shape and relative position of each partition.

9. The apparatus of claim 8 wherein the shape of said light control partitions is selected from the group consisting of triangular, polygonal, trapezoidal, round and oval.

10. The apparatus of claim 1 including a collimator structure overlying said light receiving end.

11. The apparatus of claim 1 wherein said light distributing end is enclosed by a light diffuser sheet.

12. The apparatus of claim 2 wherein said tilt adjustment mechanism is a member selected from the group consisting of adjustable bracket, rotatable screw jacks, pneumatic/hydraulic piston assemblies and electromechanical solenoid systems.

13. A solar light receiving and emitting enclosure comprising:

a rigid frame work constructed of upstanding members having uppermost ends that are interconnected with a mounting structure that defines a light receiving top opening;

each upstanding member having lowermost ends that are interconnected with bottom plates that define a light emitting bottom opening;

said framework including cross-pieces interconnecting the lower mid-portion of said upstanding members to define lower openings between corresponding bottom plates and cross-pieces and define upper openings between corresponding portions of said mounting structure and said cross-pieces;

wall structures overlying said upper openings; and light extraction panels overlying said lower openings, said light extraction panels including guide means for directing light in selected lateral directions.

14. The enclosure of claim 13 wherein said guide means consists of a member selected from the group consisting of lens structures, light deflecting baffles, prisms, polarized light film, holographic light film, reflectors, shutters and tilt adjustment mechanisms for rotating said light extraction panels away from said enclosure.

15. The enclosure of claim 13 including one or more light control partitions positioned within said enclosure above said light emitting bottom opening.

16. The enclosure of claim 15 wherein said one or more partitions are each connected by a hinge to portions of said framework for angular displacement relative to said light emitting bottom opening.

17. The enclosure of claim 15 wherein said light receiving top opening is covered with a light collimator sheet and said light emitting bottom opening is covered with a light diffuser sheet.

18. A solar light side emitting system comprising:

a light enclosure having side walls with reflective interior surfaces and a light admitting top opening and a light emitting bottom opening;

a light diffuser sheet positioned in said bottom opening; and, said enclosure having a lower wall opening within which is incorporated light extraction panels for directing light admitted through said top opening out the side of said enclosure.

19. The system of claim 18 wherein said light extraction panels include guide means for directing light out of said enclosure at predetermined angles.

20. The system of claim 19 wherein said enclosure has a polygonal cross-sectional shape and comprises interconnected wall structures supported by a rigid framework.

21. The system of claim 18 wherein said enclosure includes a rigid framework and said light extraction panels have a top edge and a bottom edge, either one of said edges including a hinge that is attached to said framework.

22. The system of claim 21 wherein said light extraction panels include a tilt adjustment mechanism for releasably fixing the angle of said light extraction panel relative to a corresponding enclosure side wall.

23. The system of claim 18 wherein said enclosure includes a light collimating sheet positioned over said top opening.

24. The system of claim 18 wherein said enclosure has an interior that includes at least one light control partition mounted to said enclosure above said bottom opening.

25. The system of claims 24 wherein said light control partition has a predetermined size and shape to effect the emission of a desired light pattern from said bottom opening.

* * * * *